United States Patent [19]

Alexander

[11] Patent Number: 4,822,505

[45] Date of Patent: Apr. 18, 1989

[54] LOAD-CARRYING GREASE

[75] Inventor: A. Gordon Alexander, Sarnia, Ontario, Canada

[73] Assignee: Exxon Research and Engineering Company, Florham Park, N.J.

[21] Appl. No.: 80,454

[22] Filed: Jul. 31, 1987

[51] Int. Cl.[4] ..... C10M 105/32

[52] U.S. Cl. ..... 252/32.7 E; 252/52 R

[58] Field of Search ..... 252/32.7 E

[56] References Cited

U.S. PATENT DOCUMENTS

| | | | |
|---|---|---|---|
| 2,734,865 | 2/1956 | Peeso | 252/32.7 E |
| 2,858,273 | 10/1958 | Worth | 252/33.6 |
| 3,133,020 | 5/1964 | Scott | 252/33.6 |
| 3,281,356 | 10/1966 | Coleman | 252/32.7 E |
| 4,053,424 | 10/1977 | Coleman | 252/32.7 E |
| 4,105,571 | 8/1978 | Shaub | 252/32.7 E |
| 4,151,099 | 4/1979 | Nassry | 252/32.7 E |
| 4,312,768 | 1/1982 | Nassry | 252/32.7 E |
| 4,313,836 | 2/1982 | Nassry | 252/32.7 E |

FOREIGN PATENT DOCUMENTS

| | | | |
|---|---|---|---|
| 2304583 | 8/1974 | Fed. Rep. of Germany | 252/32.7 E |
| 7234908 | 10/1966 | Japan | 252/32.7 E |
| 1089463 | 11/1967 | United Kingdom | 252/32.7 E |

*Primary Examiner*—William R. Dixon, Jr.
*Assistant Examiner*—J. M. Hunter, Jr.
*Attorney, Agent, or Firm*—John W. Ditsler

[57] ABSTRACT

A grease composition having improved load-carrying capability is disclosed. More specifically, the load-carrying capability of a grease is increased when a polyhydric alcohol having at least three hydroxy groups and at least two metal hydrocarbylthiophosphate compounds in which the metal is different in at least two compounds are incorporated into said grease. Glycerol is a preferred polyhydric alcohol while antimony dialkyldithiosphosphate and zinc dialkyldithiophosphate are preferred hydrocarbylthiophosphate compounds.

43 Claims, No Drawings

LOAD-CARRYING GREASE

BACKGROUND OF THE INVENTION

1. Field of the Invention

The present invention relates to a grease composition having improved load-carrying properties and a method of its preparation.

2. Description of Related Art

The use of polyhydric alcohols such as glycerol as a grease additive is known. For example, U.S. Pat. No. 2,858,273 (the disclosure of which is incorporated herein by reference) discloses incorporating a polyhydric alcohol, a metal organo-dithiocarbamate and an alkanol amine into calcium soap greases to impart extreme pressure properties. Patentee teaches that the alkanol amine is essential to provide good mechanical stability. He further teaches that alcohols containing 2 to 4 hydroxyl groups are operative in his compositions.

As another exmample, U.S. Pat. No. 3,133,020 (the disclosure of which is incorporated herein by reference) discloses a lithium based grease having improved extreme pressure properties due to the incorporation therein of an aliphatic polyhydric alcohol and a metal organodithiocarbamate.

However, none of the prior art references teach or suggest that the load-carrying capability of a grease composition can be significantly improved by incorporating therein the particular combination of additives claimed herein.

SUMMARY OF THE INVENTION

Now according to the present invention, it has been discovered that the load-carrying capability of greases can be significantly enhanced by incorporating therein a polyhydric alcohol having at least three hydroxy groups and at least two metal hydrocarbylthiophosphate compounds in which the metal is different in at least two compounds. Preferred additives are glycerol, antimony dialkyldithiophosphate and zinc dialkyldithiophosphate.

DETAILED DESCRIPTION OF THE INVENTION

The grease composition of the present invention comprises:

(a) a lubricating oil;

(b) a thickener, (c) a polyhydric alcohol having at least three hydroxy groups, and (d) at least two metal hydrocarbylthiophosphate compounds in which the metal is different in at least two compounds. The present invention also contemplates a method for preparing said composition.

A wide variety of lubricating oils can be employed in preparing the grease compositions of the present invention. Accordingly, the lubricating oil base can be any of the conventionally used mineral oils, synthetic hydrocarbon oils or synthetic ester oils, depending upon the particular grease being prepared. In general these lubricating oils will have a viscosity in the range of about 5 to about 10,000 cSt at 40° C., although typical applications will require an oil having a viscosity ranging from about 10 to about 1,000 cSt at 40° C. Mineral lubricating oil base stocks used in preparing the greases can be any conventionally refined base stocks derived from paraffinic, naphthenic and mixed base crudes. Synthetic lubricating oils that can be used include esters of glycols such as a $C_{13}$ oxo acid diester of tetraethylene glycol, or comples esters such as one formed from 1 mole of sebacic acid and 2 moles of tetraethylene glycol and 2 moles of 2-ethylhexanoic acid. Other synthetic oils that can be used include synthetic hydrocarbons such as polyalphaolefins; alkyl benzenes, e.g. alkylate bottoms from the alkylation of benzene with tetrapropylene, or the copolymers of ethylene and propylene; silicon oils, e.g. ethyl phenyl polysiloxanes, methyl polysiloxanes, etc.; polyglycol oils, e.g. those obtained by condensing butyl alcohol with propylene oxide; carbonate esters, e.g. the product of reacting $C_8$ oxo alcohol with ethyl carbonate to form a half ester followed by reaction of the latter with tetraethylene glycol, etc. Other suitable synthetic oils include the polyphenyl esters, e.g. those having from about 3 to 7 ether linkages and about 4 to 8 phenyl groups. (See U.S. Pat. No. 3,424,678, column 3.) The amount of lubricating oil in the grease can also vary broadly, but, typically, will range from about 50 to about 98 wt.%, preferably from about 75 to about 95 wt.%, of the grease.

The grease will also contain a thickener dispersed in said lubricating oil. However, the particular thickener employed is not critical and can vary broadly. Accordingly, a thickener based on aluminum, barium, calcium, lithium and sodium soaps or their mixtures may be suitably employed. Clays, dyes, polyureas and other organic thickeners may be used as well. Pyrrolidone based thickeners can also be used. Preferred thickeners are fatty acid soaps of lithium, calcium, their complexes or mixtures thereof. A lithium complex based thickener is particularly useful in the grease of the present invention. The amount of thickener in the grease will typically range from about 1 to about 30 wt.% of the grease, depending upon the physical characteristics desired in the finished grease. For most purposes, between about 5 to about 20 wt.%, preferably from about 10 to about 15 wt.%, of said thickener will be present in the grease. Usually, the greases of the present invention are prepared by dispersing or mixing the thickener in the lubricating oil followed by heating at elevated temperatures (e.g. from about 40° to about 260° C. depending upon the particular thickener used) until the mixture thickens. Subsequently, the hot grease is cooled and additional oil and additives are incorporated to provide the final product. More specific information on grease preparation techniques may be found in C. J. Boner, Manufacture and Application of Lubricating Greases, Reinhold Publishing Corp., New York (1954) and NLGI Lubricating Grease Guide, First Edition, Published by NLGI, Kansas City, Miss. (1984), the disclosures of which are incorporated herein by reference.

Any of the aliphatic polyhydric alcohols having at least 3 hydroxy groups can be employed in the grease of the present invention. Alcohols containing 3 or 4 hydroxy groups are preferred. Specific examples of alcohols which may be used include glycerol, pentaerythritol, and the like. Alcohols containing 3 hydroxy groups are more preferred, glycerol being particularly preferred. However, the other alcohols may also provide a substantial improvement in load carrying capability of the grease.

The metal hydrocarbylthiophosphate compounds added to the grease may be represented by the formula:

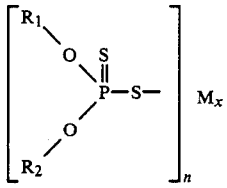

wherein n is 1–6, preferably 2–4 and more preferably 2–3; and x is 1–3, preferably 1–2 and preferably 1. $R_1$ and $R_2$ may each individually be a hydrocarbyl group and more particularly an alkyl, aryl, alkaryl or aralkyl group and the unsaturated counterparts thereof of 1 to 30, preferably 1 to 20 and more preferably 1 to 10 carbon atoms and one of $R_1$ or $R_2$ may be hydrogen. The groups as defined for $R_1$ and $R_2$ may include heterooxygen, nitrogen, sulfur or phosphorus atoms interspersed therein. Preferred hydrocarbylthiophosphate compounds are the alkylthiophosphates, with dialkyldithiophosphates being most preferred.

M can be any metal selected from the group of aluminum, antimony, cadmium, copper, lead, tin and zinc. Preferred metals are antimony, lead and zinc, with antimony and zinc being most preferred. Thus, preferred metal hydrocarbylthiophosphates include antimony dialkyldithiophosphates, lead dialkyldithiophosphates and zinc dialkyldithiophosphates. Accordingly, preferred metal hydrocarbylthiophosphate groups added to the present invention include antimony dialkyldithiophosphates in combination with lead dialkyldithiophosphates, zinc dialkyldithiophosphatesz or their mixtures, with antimony dialkyldithiophosphates and zinc dialkyldithiophosphates being most preferred.

Although very minor amounts of the polyhydric alcohol and the metal hydrocarbylthiophosphate compounds provide improvement in the load-carrying capability of greases, these additives will normally be employed within certain ranges. In the case of the polyhydric alcohol, from about 0.1 to about 5 wt.%, preferably from about 0.2 to 1.0 wt.%, based on weight of the grease, will be employed. The total amount of metal hydrocarbylthiophosphate used will range from about 0.2 to about 10 wt.%, preferably from about 0.5 to about 4 wt.%, based on weight of the grease. Methods of preparing the polyhydric alcohol and metal hydrocarbylthiophosphate compounds used herein are well known to one skilled in the art.

The polyhydric alcohol and metal hydrocarbylthiophosphate compounds are preferably added to the grease during the final steps of its preparation. The grease may also contain small amounts of conventional additives which include, but are not limited to, anticorrosive agents, pour point depressants, tackiness agents, viscosity improvers, oxidation inhibitors, dyes and the like, which are incorporated for specific purposes.

The multipurpose grease of the present invention has a variety of uses and may be suitably employed in essentially any application requiring a grease, including use in wheel bearings, industrial equipment and the like.

The present invention will be further understood by reference to the following Examples which are not interested to restrict the scope of the claims appended hereto. In the Examples, the load-carrying characteristics of the various greases were determined by means of tests performed on a Timken test machine. In the Timken test, a hardened steel ring or "cup" is rotated against a hardened steel test block while being lubricated with the grease under test. A test grease is deemed a "failure" if the test block is damaged during the test, and a "pass" if the test block is not damaged. Further details regarding the Timken test procedure may be found in ASTM method D-2782, the disclosure of which is incorporated herein by reference.

EXAMPLE 1

Effect of Polyhydric Alcohol and Metal Dialkyldithiophosphates on the Timken Response of Lithium Complex Greases Timken tests were performed on several lithium complex base greases containing various amounts of antimony dialkyldithiophosphate, zinc dialkyldithiophosphate and glycerol. The results of these tests are shown in Table 1.

TABLE 1

| | Test Sample | | | | | | | |
|---|---|---|---|---|---|---|---|---|
| | A | B | C | D | E | F | G | H |
| Composition, Wt. % | | | | | | | | |
| Base grease(1) | 100.0 | 99.75 | 98.50 | 99.70 | 98.25 | 99.45 | 98.20 | 97.95 |
| Zinc dialkyldithiophosphate | — | — | 1.50 | — | 1.50 | — | 1.50 | 1.50 |
| Antimony dialkyldithiophosphate | — | 0.25 | — | — | 0.25 | 0.25 | — | 0.25 |
| Glycerol | — | — | — | 0.30 | — | 0.30 | 0.30 | 0.30 |
| Penetration, mm/10(2) | 268 | 268 | 270 | 264 | 270 | 264 | 266 | 270 |
| Timken Test | | | | | | | | |
| Pass, lb | — | — | 20 | — | 30,35 | — | 30 | 70,75 |
| Fail, lb | 20,20(3) | 30,20(3) | 30,25(3) | 20(3) | 40(4) | 20(3) | 40,35(3) | 80(4) |

(1)A lithium complex base grease (NLGI #2) with a fluid viscosity of about 220 cSt at 40° C. and a thickener content of about 14 wt. %.
(2)Worked sixty strokes.
(3)Severe scoring of test block.
(4)Light scoring of test block.

The data in Table 1 show that the load-carrying capability of a lithium complex grease is significantly enhanced when glycerol and two metal dialkyldithiophosphate compounds each having a different metal component are added to said grease.

EXAMPLE 2

Effect of Auxiliary Additives on the Timken Response of a Fully Formulated Lithium Complex Grease Timken tests were preformed on two samples of the same fully formulated lithium complex grease which contain antimony dialkyldithiophosphate, zinc dialkyldithiophosphate and other additives. One sample also contained glycerol. The results of these tests are shown in Table 2.

TABLE 2

| | Test Sample | |
|---|---|---|
| | I | J |
| Composition, wt. % | | |
| Base Grease(1) | 94.64 | 94.34 |
| Antimony dialkyldithiophosphate | 0.25 | 0.25 |
| Zinc dialkyldithiophosphate | 1.52 | 1.52 |
| Glycerol | — | 0.3 |
| Other additives(2) | 3.59 | 3.59 |
| Timken Test | | |
| Pass, lbs. | 30 | 70 |
| Fail, lbs. | 70, 60, 50, 40, 35 | 75 |

(1)A lithium complex base grease (NLGI #2) with a fluid viscosity of about 220 cSt at 40° C. and a thickener content of about 14 wt. %.
(2)Includes antirust agent, copper corrosion inhibitor, antioxidant, tackiness agent and a dye.

The data in Table 2 show that the addition of glycerol, antimony dialkyldithiophosphate and zinc dialkyldithiophosphate to a fully formulated lithium complex grease results in a significant increase in the load-carrying capability of the grease. The data also show that other additives do not affect the Timken response of the grease.

EXAMPLE 3

Effect of Metal Dialkylidithiophosphate Concentration on the Timken Response of a Lithium Complex Grease Timken tests were performed on two samples of the same lithium complex base grease having an increased concentration of zinc dialkyldithiophosphate in one sample and an increased concentration of antimony dialkyldithiophosphate in the other. A ployhydric alcohol was not present in either sample. The results of these tests are shown in Table 3.

TABLE 3

| | Test Sample | |
|---|---|---|
| | K | L |
| Composition, wt. % | | |
| Base Grease(1) | 97.0 | 98.5 |
| Zinc dialkyldithiophosphate | 3.0 | — |
| Antimony dialkyldithiophosphate | — | 1.5 |
| Timken Test | | |
| Pass, lbs. | 20 | 30, 50, 60, 80 |
| Fail, lbs. | 30, 25 | — |

(1)A lithium complex base grease (NLGI #2) with a fluid viscosity of about 220 cSt at 40° C. with a thickener content of about 14 wt. %.

Test sample K in Table 3 shows that the addition of 3.0 wt.% of zinc dialkyldithiophosphate to a lithium complex base grease does not enhance the load-carrying capability of said grease. This is consistent with test sample C in Table 1 which used 1.5 wt.% zinc dialkyldithiophosphate. Thus, the load-carrying capability of a grease is not improved by increased concentrations of zinc dialkyldithiophosphates.

In contrast, test sample L in Table 3 shows that the addition of 1.5 wt.% antimony dialkyldithiophosphate to a lithium complex base grease dramatically increases the load-carrying capability of the grease (for comparision, see test sample B in Table 1 which used 0.25 wt.% antimony dialkyldithiophosphate). However, copper corrosion performance of test sample L was unacceptable as a value of 4 (heavy corrosion) was obtained using ASTM D 130/IP 154. When test sample B in Table 1 was subjected to ASTM D 130/IP 154, the sample passed with an acceptable value of 1. Thus, use of the additive system of the present invention allows the grease manufacturer to obtain the load-carrying benefits of antimony dialkyldithiophosphate, but at concentrations which do not result in unacceptable corrosion.

EXAMPLE 4

Effect of Glycerol on the Timken Response of a Simple Lithium Grease

Timken tests were performed on two samples of a fully formulated simple lithium grease containing antimony dialkyldithiophosphate and zinc dialkyldithiophosphate in which glycerol was added to one sample. The results of these tests are shown in Table 4.

TABLE 4

| | Test Sample | |
|---|---|---|
| | M | N |
| Composition, wt. % | | |
| Base Grease(1) | 97.49 | 97.19 |
| Zinc dialkyldithiophosphate | 1.54 | 1.54 |
| Antimony dialkyldithiophosphate | 0.13 | 0.13 |
| Glycerol | — | 0.30 |
| Other additives(2) | 0.84 | 0.84 |
| Timken Test | | |
| Pass, lbs. | 40 | 50 |
| Fail, lbs. | 50, 45 | 60, 55 |

(1)A simple lithium complex grease (NLGI #2) with a fluid viscosity of about 220 cSt at 40° C. and a thickener content of about 14 wt. %.
(2)Includes antirust agent, copper corrosion inhibitor, antioxidant and tackiness agent.

The data in Table 4 shows that the load-carrying capability of a simple lithium grease is also enhanced when a polyhydric alcohol and two dialkyldithiophosphate compounds having different metals are added.

EXAMPLE 5

Effect of polyhydric Alcohols on the Timken Response of a Lithium Complex Grease Timken tests were performed on two samples of the same lithium complex base grease containing antimony dialkyldithiophosphate and zinc dialkyldithiophosphate in which glycerol was added to one sample and propylene glycol to the other. The results of these tests are shown in Table 5.

TABLE 5

| | Test Sample | |
|---|---|---|
| | O | P |
| Composition, wt. % | | |
| Base Grease(1) | 97.25 | 97.95 |
| Zinc dialkyldithiophosphate | 1.5 | 1.5 |
| Antimony dialkyldithiophosphate | 0.25 | 0.25 |
| Glycerol | 1.0 | — |
| Propylene glycol | — | 0.3 |
| Penetration, mm/10(2) | 265 | 272 |
| Timken Test | | |
| Pass, lbs. | 70, 75 | — |
| Fail, lbs. | 80 | 60, 40, 20 |

(1)A lithium complex base grease (NLGI #2) with a fluid viscosity of about 220 cSt at 40° C. and a thickener content of about 14 wt. %.
(2)Worked sixty strokes.

Test sample H in Table 1 and test sample 0 in Table 5 show that increasing the amount of glycerol from 0.3 to 1.0 wt.% does not increase the load-carrying capability of a grease. Test sample P in Table 5 shows that using 0.3 wt.% propylene glycol (a polyhydric alcohol having two hydroxy groups) instead of glycerol does not increase the load-carrying capability of said grease.

What is claimed is:

1. A grease composition having improved load-carrying capability which comprises:
(a) a lubricating oil,
(b) a thickener,
(c) a polyhydric alcohol having at least three hydroxy groups, and
(d) at least two metal hydrocarbylthiophosphate compounds in which the metal is different in at least two compounds.

2. The composition of claim 1 wherein said polyhydric alcohol is selected from the group consisting of glycerol, pentaerythritol, and mixtures thereof.

3. The composition of claim 1 wherein the metal hydrocarbylthiophosphate compounds have the formula:

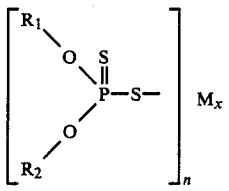

wherein n is 1–6; x is 1–3; $R_1$ and $R_2$ may each be hydrogen or a hydrocarbyl group having from 1 to 30 carbon atoms; and M is a metal selected from the group consisting of aluminum, antimony, cadmium, copper, lead, tin, zinc and mixtures thereof.

4. The composition of claim 3 wherein said hydrocarbyl group is an alkyl, aryl, alkaryl, aralkyl group or mixtures thereof.

5. The composition of claim 3 wherein said metal hydrocarbylthiophosphate compounds are metal alkylthiophosphate compounds.

6. A grease composition having improved load-carrying capability which comprises:
(a) a lubricating oil,
(b) a thickener,
(c) a polyhydric alcohol selected from the group consisting of glycerol, pentaerythritol, hexylene glycol, butylene glycol, pentylene glycol and mixtures thereof, and
(d) at least two metal hydrocarbylthiophosphate compounds having the formula:

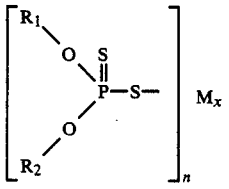

wherein n is 1–6; x is 1–3; $R_1$ and $R_2$ may each be hydrogen or a hydrocarbyl group having from 1 to 30 carbon atoms; and M is a metal selected from the group consisting of aluminum, antimony, cadmium, copper, lead, tin, zinc and mixtures thereof; in which the metal is different in at least two compounds.

7. The composition of claim 6 wherein said polyhydric alcohol comprises glycerol.

8. The composition of claim 6 wherein n is 2–4.

9. The composition of claim 8 wherein n is 2–3.

10. The composition of claim 6 wherein x is 1–2.

11. The composition of claim 10 wherein x is 1.

12. The composition of claim 6 wherein said metal hydrocarbylthiophosphate compounds comprise at least two metal alkylthiophosphate compounds.

13. The composition of claim 12 wherein said metal is selected from the group consisting of antimony, lead, zinc and mixtures thereof.

14. The composition of claim 12 wherein said metal alkylthiophosphate compounds comprise two metal dialkyldithiophosphate compounds.

15. The composition of claim 14 wherein said metal dialkyldithiophosphate compounds are antimony dialkyldithiophosphate and zinc dialkyldithiophosphate.

16. The composition of claim 6 wherein said thickener is based on a fatty acid soap of calcium, lithium, their complexes or mixtures thereof.

17. A grease composition having improved load-carrying capability which comprises:
(a) a lubricating oil
(b) a lithium complex based thickener,
(c) from about 0.1 to about 5 wt.% glycerol, and
(d) from about 0.2 to about 10 wt.% of at least two metal dialkyldithiophosphate compounds in which the metal is different in at least two compounds.

18. The composition of claim 17 wherein the amount of glycerol added ranges from about 0.2 to about 1.0 wt.%.

19. The composition of claim 17 wherein the amount of metal dialkyldithiophosphate compounds added ranges from about 0.5 to about 4 wt.%.

20. The composition of claim 17 wherein said metal dialkyldithiophosphate compounds are antimony dialkyldithiophosphate and zinc dialkyldithiophosphate.

21. A method for improving the load-carrying capability of a grease which comprises adding to said grease:
(a) a polyhydric alcohol having at least three hydroxy groups, and
(b) at least two metal hydrocarbylthiophosphate compounds in which the metal is different in at least two compounds.

22. The method of claim 21 wherein said polyhydric alcohol is selected from the group consisting of glycerol, pentaerythritol, and mixtures thereof.

23. The method of claim 21 wherein the metal hydrocarbylthiophosphate compound is of the formula:

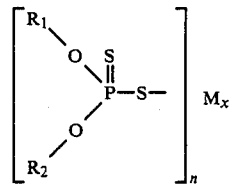

wherein n is 1–6; x is 1–3; $R_1$ and $R_2$ may each be hydrogen or a hydrocarbyl group having from 1 to 30 carbon atoms; and M is a metal selected from the group consisting of aluminum, antimony, cadmium, copper, lead, tin, zinc and mixtures thereof.

24. The method of claim 23 wherein said hydrocarbyl group in an alkyl, aryl, alkaryl, aralkyl group or mixtures thereof.

25. The method of claim 23 wherein said metal hydrocarbylthiophosphate compounds are metal alkylthiophosphate compounds.

26. A method for improving the load-carrying capability of a grease which comprises adding to said grease:

(a) a polyhydric alcohol selected from the group consisting of glycerol, pentaerythritol, and mixtures thereof, and (b) at least two metal hydrocarbylthiophosphate compounds having the formula:

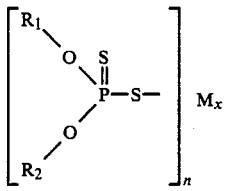

wherein n is 1–6; x is 1–3; $R_1$ and $R_2$ may each be hydrogen or a hydrocarbyl group having from 1 to 30 carbon atoms; and M is a metal selected from the group consisting of aluminum, antimony, cadmium, copper, lead, tin, zinc and mixtures thereof, in which the metal is different in at least two compounds.

27. The method of claim 26 wherein said polyhydric alcohol comprises glycerol.

28. The method of claim 26 wherein said metal hydrocarbylthiophosphate compounds comprise at least two metal alkylthiophopsphate compounds.

29. The method of claim 28 wherein said metal is selected from the group consisting of antimony, lead, zinc and mixtures thereof.

30. The method of claim 28 wherein said metal alkylthiophosphate compounds comprise two metal dialkyldithiophosphate compounds.

31. The method of claim 30 wherein said metal dialkyldithiophosphate compounds are antimony dialkyldithiophosphate and zinc dialkyldithiophosphate.

32. The method of claim 26 wherein said thickener is based on a fatty acid soap of calcium, lithium, their complexes or mixtures thereof.

33. A method for improving the load-carrying capability of a grease which comprises adding to said grease:

(a) from about 0.1 to about 5 wt.% glycerol, and (b) from about 0.2 to about 10 wt.% of at least two metal dialkyldithiophosphate compounds in which the metal is different in at least two compounds.

34. The method of claim 33 wherein the amount of glycerol added ranges from about 0.2 to about 1.0 wt.%.

35. The method of claim 33 wherein the amount of metal dialkyldithiophosphate compounds added ranges from about 0.5 to about 4 wt.%.

36. The method of claim 33 wherein said metal dialkyldithiophosphate compounds are antimony dialkyldithiophosphate and zinc dialkyldithiophosphate.

37. A method for reducing the corrosiveness of a grease which comprises adding to said grease (a) a polyhydric alcohol having at least three hydroxy groups, and (b) at least two metal hydrocarbylthiophosphate compounds in which the metal is different in at least two compounds.

38. The method of claim 37 wherein said polyhydric alcohol is selected from the group consisting of glycerol, pentaerythritol, and mixtures thereof.

39. The method of claim 38 wherein said polyhydric alcohol comprises glycerol.

40. The method of claim 38 wherein said metal hydrocarbylthiophosphate compounds comprise at least two metal alkylthiophosphate compounds.

41. The method of claim 40 wherein said metal is selected from the group consisting of antimony, lead, zinc and mixtures thereof.

42. The method of claim 41 wherein said metal alkylthiophosphate compounds comprise two metal dialkyldithiophosphate compounds.

43. The method of claim 42 wherein said metal dialkyldithiophosphate compounds are antimony dialkyldithiophosphate and zinc dialkyldithiophosphate.

* * * * *